United States Patent [19]

Manning

[11] 4,357,283

[45] Nov. 2, 1982

[54] CARBURETOR

[75] Inventor: William O. Manning, Warren, Mich.

[73] Assignee: Colt Industries Operating Corp., New York, N.Y.

[21] Appl. No.: 93,113

[22] Filed: Nov. 13, 1979

[51] Int. Cl.[3] ..... F02M 11/02

[52] U.S. Cl. ..... 261/23 A; 261/44 E

[58] Field of Search ..... 261/23 A, 47, 56, 44 E

[56] References Cited

U.S. PATENT DOCUMENTS

| | | | |
|---|---|---|---|
| 1,851,343 | 3/1932 | Ball et al. | 261/47 |
| 2,355,716 | 8/1944 | Ericson et al. | 261/23 A |
| 2,752,131 | 6/1956 | Gretz | 261/23 A |
| 2,871,001 | 1/1959 | Stoltman | 261/23 A |
| 2,877,003 | 3/1959 | Goodridge et al. | 261/62 |
| 4,172,864 | 10/1979 | Hohsho et al. | 261/39 D |

*Primary Examiner*—Tim R. Miles

*Attorney, Agent, or Firm*—Walter Potoroka, Sr.

[57] ABSTRACT

A carburetor having an induction passage with an inlet end and an outlet end for discharging into a corresponding inlet of an associated intake manifold of a combustion engine has a venturi and a main fuel discharge nozzle in association therewith within the induction passage and a throttle valve downstream of the venturi and main fuel discharge nozzle for controlling the discharge of motive fluid from the outlet end and into inlet of the intake manifold; a second induction passage generally in parallel with a portion of the first mentioned induction passage is also provided with an inlet and outlet along with a throttle valve and a fuel discharge passage therebetween; the outlet of the second induction passage is placed in communication with the first mentioned induction passage as to be generally between the venturi and throttle valve of the first mentioned induction passage.

9 Claims, 1 Drawing Figure

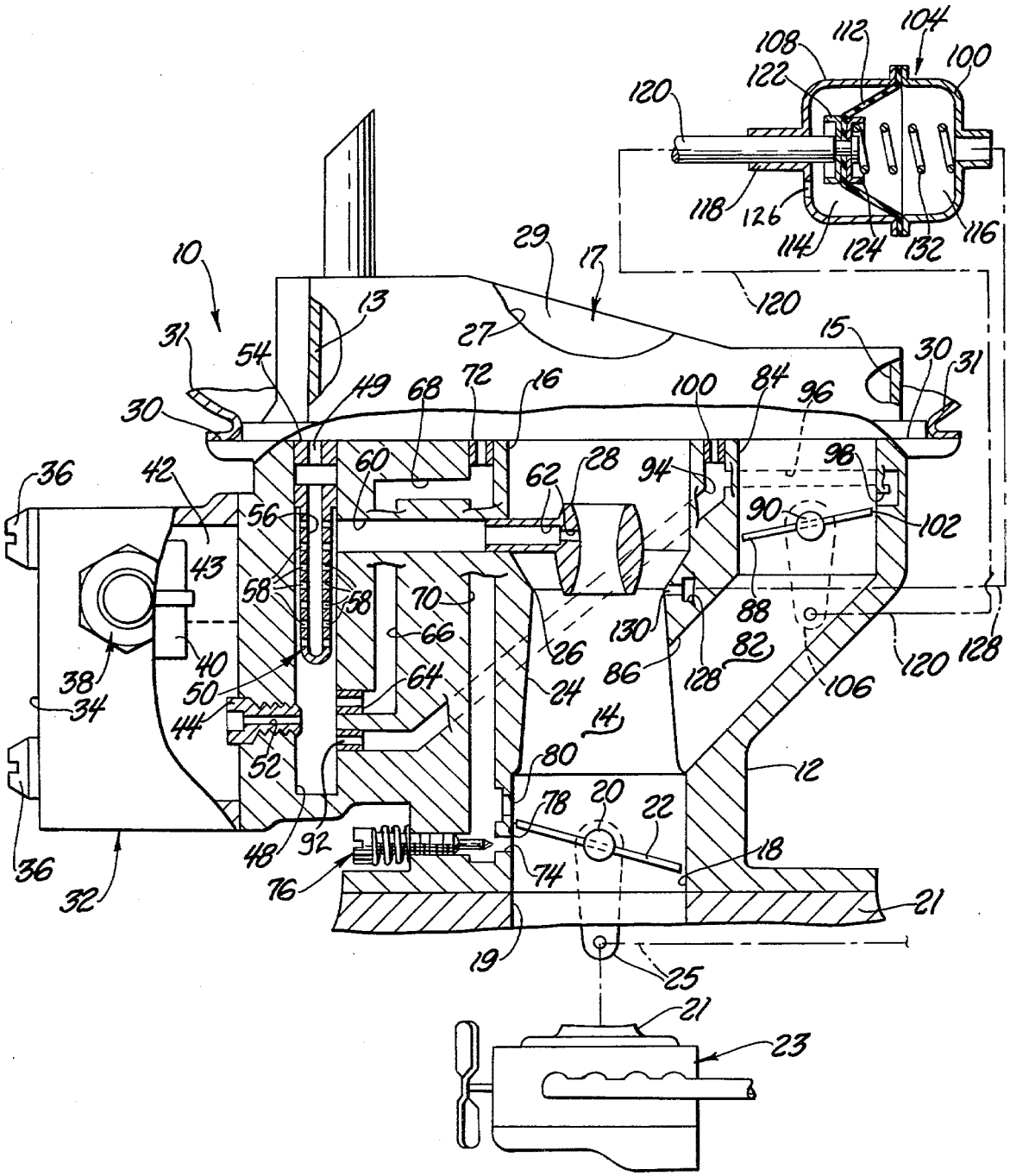
10
12
13
14
15
16
17
18
19
20
21
22
23
24
25
26
27
28
29
30
31
32
34
36
38
40
42
43
44
48
49
50
52
54
56
58
60
62
64
66
68
70
72
74
76
78
80
82
84
86
88
90
92
94
96
98
100
102
104
106
108
112
114
116
118
120
122
124
126
128
130
132

CARBURETOR

FIELD OF THE INVENTION

This invention relates generally to apparatus for metering the rate of flow of fuel and air to a combustion engine and more particularly to where such apparatus comprises a carburetor.

BACKGROUND OF THE INVENTION

Heretofore, when it was desired to obtain increased air flow through a carburetor induction passage having a fixed venturi therein, such was accomplished by enlarging the throat of the venturi until a workable compromise was attained as between the available metering force at a known low air flow and the high air flow horsepower requirements as of a particular engine. When such a compromise was attained, any desired additional air flow capacity had to be supplied as by adding secondary induction passage means or systems which were, in the main, a duplication of the primary induction passages. Such secondary induction passage means, in turn, required that the associated intake manifold of the engine also be provided with additional inlet apertures into which the secondary induction passages would discharge. This, of course, meant that a particular engine could not accommodate a single stage carburetor and a multi-stage multi-induction-passage carburetor without also having to have differing intake manifolds which would "match-up" with such different types of carburetors.

The invention as herein disclosed and claimed is primarily directed to the solution of the problems of the prior art and to provide a carburetor structure which can provide desired additional air flow capacity without the need for providing additional induction passage means respectively discharging directly into the engine intake manifold.

SUMMARY OF THE INVENTION

A carburetor, according to the invention, comprises carburetor body means, first induction passage means formed in said carburetor body means, said first induction passage means comprising a first inlet for the entrance of air and a first outlet for the discharge of air and fuel therefrom, a venturi carried within said first induction passage generally between said first inlet and first outlet, a selectively variably positionable first throttle valve situated in said first induction passage means downstream of said venturi, second induction passage means formed in said carburetor body means, said second induction passage means comprising a second inlet for the entrance of air and a second outlet for the discharge of air and fuel therefrom, a variably positionable second throttle valve situated in said second induction passage means, first fuel discharge means for discharging metered rates of fuel flow into said first induction passage means in the vicinity of said venturi, second fuel discharge means for discharging metered rates of fuel flow into said second induction passage means, and said second outlet of said second induction passage means communicating with said first induction passage means as to discharge air fuel mixtures from said second induction passage means into said first induction passage means at an area thereof generally downstream of said venturi and upstream of said first throttle valve.

Various general and specific objects, advantages and aspects of the invention will become apparent when reference is made to the following detailed description of the invention considered in conjunction with the accompanying drawing.

BRIEF DESCRIPTION OF THE DRAWING

The single drawing, wherein for purposes of clarity certain details and/or elements may be omitted while others may be illustrated in somewhat simplified form, illustrates in general axial cross-section a carburetor, embodying teachings of the invention, in association with a combustion engine.

DETAILED DESCRIPTION OF THE PREFERRED EMBODIMENT

Referring now in greater detail to the drawing, a carburetor 10 is illustrated as comprising a carburetor body 12 with a first or main induction passage 14 formed therethrough and communicating at its upper inlet end 16 as with an air inlet section 17 (in which a suitable choke valve, not shown but well known in the art, may be situated) while communicating at its lower discharge end 18 as with an inlet aperture or passage 19 leading to the interior of an intake manifold 21 of the associated engine 23. A generally transversely extending rotatable throttle shaft 20 operatively carries a throttle valve 22 for pivotal rotation therewith. Suitable control linkage means 25, as is well known in the art, may be operatively connected as to throttle shaft 20 and throttle valve 22 to effect rotation thereof in accordance with operator demands.

The air inlet section 17 may be comprised of, for example, opposed wall portions 13 and 15 which are joined to opposed wall portions 27 and 29 as to form a generally circumscribing wall defining the air inlet section.

The induction passage 14 is provided with a venturi section or portion 24 within the throat 26 of which a main fuel discharge nozzle 28 is situated so as to at times discharge metered main fuel into the main induction passage generally in accordance with the rate (velocity) of air flow through the venturi throat 26. The upper portion of carburetor body means 12 may be provided with a flange 30 formed thereabout as to receive and carry thereon a suitable air cleaner assembly 31.

A fuel bowl assembly 32, shown as comprising a housing 34, secured to body means 12 as by elongated screws 36, and a fuel inlet valve assembly 38 controlled as by a float 40 within the fuel bowl chamber 42, serves to supply liquid fuel 43 to the fuel metering restriction means 44.

A main well 48 contains a main well tube 50 and communicates generally at its lower end with the fuel 43 within fuel bowl chamber 42 as through calibrated passage 52 formed through the main metering restriction or jet 44. The upper end of main well 48 is placed in communication with a source of air as via calibrated passage 49 formed through a main fuel system air bleed or restriction 54 which may be vented to the interior of the air inlet portion 17.

As is generally well known in the art, the function of the main well tube 50, which has an axial passageway 56 and a plurality of radial apertures or passages 58 communicating between the inner passageway 56 and the interior of main well 48, is to provide a controlled rate of bleed air to be mixed with the fuel flowing upwardly through the main well and out through conduit portions 60 and 62 thereby reducing the weight of the fuel in order to make it more responsive to the variations of venturi vacuum developed as at the throat 26 of the venturi section 24. Further, as is well known in the art, the main nozzle 28 does not supply a metered rate of fuel flow to the induction passage 14 until the engine speed and load are sufficiently great to cause a rate (velocity) of air flow through the venturi throat 26 in excess of a predetermined minimum rate of such air flow.

Accordingly, for engine operating conditions wherein the actual rate of air flow through the venturi throat 26 is less than such a predetermined minimum rate, an idle fuel metering system is provided in order to supply a metered rate of idle fuel flow to the induction passage means 14. As is well known by those skilled in the art, the idle fuel system functions to meter idle fuel flow to the induction passage means 14 in accordance with the magnitude of the intake vacuum developed by the engine as within the intake manifold 21.

As generally illustrated, the idle fuel system may comprise an idle fuel metering restriction 64 communicating as between the main well 48 and a generally upwardly extending conduit portion 66 which, in turn, communicates at its upper end with a conduit portion 68 leading to a downwardly extending conduit portion 70 the upper end of which is placed in controlled communication with a source of air as through calibrated or air bleed restriction means 72. The purpose of bleed air restriction means 72 is to provide a degree of air emulsification to the fuel as it passes toward the discharge points communicating with the induction passage means.

The lower end of supply conduit 70 communicates with the induction passage means 14 as by an idle fuel discharge port 74 of which the effective flow area can be adjustably determined as by a threadably adjustable idle fuel valve 76. As indicated, the port 74 may be situated as to be disposed generally downstream of the edge 78 of throttle valve 22 when the throttle valve 22 is in its nominally closed or curb idle position. The lower end of conduit 70 may also be placed in communication with induction passage means 14 as by a second port or slot 80 located so as to be progressively traversed by the edge 78 of throttle valve 22 as the throttle valve 22 is rotated in a clockwise direction (as viewed in the drawing) toward a more fully opened position so as to thereby progressively increasing the exposure of port or discharge means 80 to the manifold vacuum below (downstream of) the throttle valve 22. Such port means 80 are generally well known in the art and are often referred to as being an idle transfer port or slot.

A second or auxiliary induction passage means 82, also formed in carburetor body means 12, has an upper air inlet end 84 and a lower disposed outlet end 86 which, as depicted, communicates with the first or main induction passage means 14 at a point or area thereof downstream of the venturi throat 26 and upstream of throttle valve means 22. A secondary or auxiliary throttle valve 88 is suitably carried as by a generally transversely extending rotatable throttle shaft 90 as to be rotatable therewith within induction passage means 82.

An auxiliary fuel metering and supply system is illustrated as comprising fuel metering restriction means 92 communicating as between the fuel 43 within chamber 42 of fuel bowl or reservoir 32 and a conduit portion 94 which, at its upper end, is in communication with a conduit portion 96 leading to metered fuel discharge means 98 which may be of any desired configuration but which is preferably of a slot-like configuration opening into induction passage means 82. A calibrated air restriction or air bleed means 100, similar to air bleed means 54 and 72, serves to controllably communicate between a source of air as, for example, chamber area 17, and the fuel within conduit means 94, 96 to thereby provide for air emulsification within such fuel.

Somewhat similarly to the coaction as between transfer slot 80 and edge 78 of throttle valve 22, as throttle valve 88 is rotated in the counter-clockwise direction (as viewed in the drawing) toward a more fully opened position, edge 102 of throttle valve 88 traverses the projected opening of fuel discharge means 98 and in so doing causes a resulting related rate of metered fuel to be discharged therefrom into induction passage means 82. During such opening movement of throttle valve 88, any degree of manifold vacuum which may exist below (downstream of) throttle valve 88 is applied to the correspondingly exposed portion of fuel discharge port means 98 and the air flowing around the throttle valve 22 and between edge 102 thereof and the generally juxtaposed fuel discharge port means 98 experiences a somewhat venturi effect thereon thereby causing a pressure reduction in that area which pressure reduction is employed in determining the metering pressure differential of the fuel being metered through the auxiliary fuel metering system.

In the preferred embodiment, the opening of throttle valve 88 is made responsive to engine load as reflected by the rate (velocity) of air flow through the primary or main induction passage means 14. This may be achieved by providing suitable pressure responsive motor means 104 operatively connected, as through lever or linkage means 106, to throttle valve 88. The motor means 104, in turn, is made responsive to the magnitude of the vacuum at venturi throat 26 which magnitude, of course, will vary as the rate (velocity) of air flow through venturi throat 26 varies.

More particularly, the pressure responsive motor means 104 is depicted as comprising housing sections 108 and 110 which cooperate to peripherally contain a pressure responsive movable wall means or diaphragm 112 as to provide for chambers 114 and 116 at opposite sides thereof. Housing section 108 may be provided with a tubular guide portion 118 for slidably guiding an actuating rod 120 which is suitably connected at one end to linkage or lever 106 and, at its other end to diaphragm 112 as through cooperating diaphragm backing plates 122 and 124 oppositely disposed about diaphragm 112. Chamber 114 may be vented to atmosphere as by aperture means 126 while chamber 116 is placed in communication with a source of venturi throat 26 pressure as by suitable conduit means 128 which may comprise a calibrated passage portion 130. Suitable resilient means such as a spring 132 within chamber 116 serves to yieldingly urge diaphragm means 112 to the left (as viewed in the drawing) and throttle valve 88 toward its nominally closed position.

OPERATION OF THE INVENTION

Generally, at curb idle engine operation, main throttle valve 22 will be in a position as generally depicted and at that time the manifold vacuum will be applied to idle fuel discharge port 74 and all of the metered fuel required to sustain engine operation will be provided through the idle fuel metering and supply system comprised as of idle metering restriction means 64, conduit portions 66, 68 and 70 and discharge port 74.

As more engine loads are experienced and primary throttle valve 22 is opened toward a more fully opened position, edge 78 begins to traverse transfer slot 80 and in so doing the intake or manifold vacuum downstream of the primary throttle valve 22 is progressively applied to an ever increasing area of the transfer discharge port means 80 and all of the metered fuel required to sustain engine operation under such increased or increasing engine loads will be provided through idle metering restriction means 64, conduit portions 66, 68 and 70, idle discharge port 74 and the effectively opened portion of transfer port 80.

It should of course be apparent, as it is well known in the art, that as such engine loads increase, the rate (velocity) of air flow through the venturi throat 26 increases. At a time prior to when the transfer port 80 is fully exposed, the velocity of air flow through the venturi throat 26 has increased sufficiently as to cause the main fuel metering and supply system to start to provide metered fuel flow to the induction passage means 14 as via metering restriction means 44, main well 48, conduit means 60 and 62 and discharge nozzle means 28. As the engine loads continue to increase, the throttle valve 22 is further opened and the velocity of air flow through venturi throat 26 increases causing an increase in the magnitude of the venturi vacuum and, of course, an increase in the rate of metered fuel being supplied through nozzle means 28 to the induction passage 14.

At a preselected value of such venturi vacuum, as sensed at port means 130 and communicated via conduit means 128 to chamber 116, the resulting pressure differential across diaphragm 112 becomes sufficient to start diaphragm means 112 and actuator 120 to start to move to the right against the resilient resistance of spring 132 to thereby correspondingly start to move secondary throttle valve 88 in the more nearly opened direction. As throttle valve 88 is thusly opened, additional rates of flow of air are permitted through the secondary induction passage and corresponding increased amounts of metered fuel flow are supplied via discharge port means 98.

As a consequence, the carburetor structure of the invention is able to provide for not only accurate and responsive fuel-air metering at low engine power demands, but is also able to provide for the same accuracy and responsiveness even at engine power demands which would be beyond the capability of the main or primary induction passage means 14, itself. This is all accomplished while still employing the same discharge bore 19 and without the necessity of having to provide for additional inlet bores in the cooperating engine intake manifold 21. In effect, induction passage means 82 bypasses the venturi section 24 and venturi throat 26 of the induction passage means 14 and the throttle valve 88 thereof is in effect a bypass throttle valve controlling the degree of bypass flow permitted through bypass induction passage means 82.

Even though the preferred embodiment has the bypass throttle 88 opened in response to venturi vacuum, it is nevertheless contemplated that if the bypass throttle 88 is to be opened in response to engine load, means may be provided for thusly opening throttle valve 88 which are responsive to manifold vacuum or to a combination of venturi vacuum and intake manifold vacuum. Also, it is further contemplated that the bypass throttle 88 may be mechanically opened as through suitable linkage means operatively interconnecting the main or primary throttle valve 22 with the bypass throttle valve 88.

Although only a preferred embodiment of the invention has been disclosed and described, it is apparent that other embodiments and modifications of the invention are possible within the scope of the appended claims.

What is claimed is:

1. A carburetor for a combustion engine, comprising carburetor body means, first induction passage means formed in said carburetor body means, said first induction passage means comprising first inlet means for the entrance of air and first outlet means for the discharge of air and fuel therefrom, venturi means having venturi throat means carried within said first induction passage means generally between said first inlet means and first outlet means, selectively variably positionable first throttle valve means situated in said first induction passage means downstream of said venturi means, second induction passage means, said second induction passage means comprising second inlet means for the entrance of air and second outlet means for the discharge of air and fuel therefrom, variably rotatably positionable second throttle valve means situated in said second induction passage means downstream of said second inlet means and upstream of said second outlet means, said second throttle valve means comprising a plate-like throttle valve member, a throttle shaft for rotatably carrying said throttle valve member, said throttle valve member having first and second peripheral edge portions generally rotatably swingable about the axis of said throttle shaft when said throttle valve member is rotated about said axis of said throttle shaft, said first swingable peripheral edge portion rotatably swinging in generally the upstream direction of said second induction passage means when said throttle valve member is rotated about said axis of said throttle shaft in a throttle opening direction, said second swingable peripheral edge portion rotatably swinging in generally the downstream direction of said second induction passage means when said throttle valve member is rotated about said axis of said throttle shaft in said throttle opening direction, when in a closed throttle position said throttle valve member extending generally transversely of said second induction passage means as to have said first and second swingable peripheral edge portions at least closely disposed to the surface defining said second induction passage means, first fuel discharge means for discharging metered rates of fuel flow into said first induction passage means, second fuel discharge means for discharging metered rates of fuel flow into said second induction passage means, said second fuel discharge means comprising a discharge port formed in said surface defining said second induction passage means, said discharge port being situated as to be generally upstream of said first swingable edge portion of said throttle valve member when said throttle valve member is in said closed throttle position, said discharge port being generally traversed by said first swingable edge portion as said throttle valve member moves from said closed throttle position toward a more fully opened throttle position thereby exposing a progressively increasing area of said discharge port to such vacuum as may exist in said second induction passage means downstream of said throttle valve member but upstream of said first throttle valve means, the rate of fuel being discharged into said second induction passage means from said discharge port being dependent upon the area of said discharge port exposed by said first swingable edge of said throttle valve member and the magnitude of said vacuum generally between said first throttle valve means and said throttle valve member and independent of the velocity of the rate of air flow through said second induction passage means, and said second outlet means of said second induction passage means communicating directly with said first induction passage means as to discharge air-fuel mixtures from said second induction passage means into said first induction passage means at an area thereof downstream of said venturi throat means and upstream of said first throttle valve means.

2. A carburetor according to claim 1 wherein said second throttle valve means is automatically opened in response to the attainment of a predetermined magnitude of engine load of said combustion engine.

3. A carburetor according to claim 1 and further comprising pressure responsive motor means for controllably opening said second throttle valve means, said pressure responsive motor means being actuated in response to vacuum created by the rate of air flow through said first induction passage means to said engine.

4. A carburetor according to claim 1 and further comprising pressure responsive motor means operatively connected to said second throttle valve means, said motor means comprising pressure responsive movable wall means, linkage means operatively connected to said second throttle valve means and said pressure responsive movable wall means as to be movable therewith, and conduit means for communicating the venturi vacuum existing at said venturi throat means to said pressure responsive movable wall means in order to thereby cause said pressure responsive wall means and said linkage means to move in a direction causing said second throttle valve means to move in a throttle valve opening direction whenever the magnitude of said venturi vacuum exceeds a preselected magnitude.

5. A carburetor according to claim 4 and further comprising spring means effective for yieldingly urging said second throttle valve means toward a closed throttle valve position.

6. A carburetor according to claim 1 wherein said second induction passage means is formed in said carburetor body means.

7. A carburetor according to claim 1 wherein said second induction passage means comprises a single second induction passage.

8. A carburetor according to claim 1 wherein said firt induction passage means comprises a single first induction passage.

9. A carburetor according to claim 1 wherein said first induction passage means comprises a single first induction passage, and wherein said second induction passage means comprises a single second induction passage.

* * * * *